US011306546B2

(12) United States Patent
Napier

(10) Patent No.: US 11,306,546 B2
(45) Date of Patent: Apr. 19, 2022

(54) CAM INDEXING APPARATUS

(71) Applicant: Halliburton Energy Services, Inc., Houston, TX (US)

(72) Inventor: Rory Archibald Napier, Montrose (GB)

(73) Assignee: Halliburton Energy Services, Inc., Houston, TX (US)

( * ) Notice: Subject to any disclaimer, the term of this patent is extended or adjusted under 35 U.S.C. 154(b) by 822 days.

(21) Appl. No.: 16/072,110

(22) PCT Filed: Jun. 28, 2017

(86) PCT No.: PCT/US2017/039665

§ 371 (c)(1),
(2) Date: Jul. 23, 2018

(87) PCT Pub. No.: WO2019/005029

PCT Pub. Date: Jan. 3, 2019

(65) Prior Publication Data

US 2021/0207442 A1 Jul. 8, 2021

(51) Int. Cl.
*E21B 17/046* (2006.01)
*E21B 34/06* (2006.01)

(52) U.S. Cl.
CPC ..... *E21B 17/046* (2013.01); *E21B 34/06* (2013.01)

(58) Field of Classification Search
CPC ..... E21B 17/046; E21B 34/06
See application file for complete search history.

(56) References Cited

U.S. PATENT DOCUMENTS 508,652 A 11/1893 Elihu et al.
7,870,908 B2 * 1/2011 Mandrou ..... E21B 34/10 166/386
8,403,067 B2 3/2013 Knobloch, Jr. et al.
8,844,634 B2 9/2014 Clausen et al.
(Continued)

FOREIGN PATENT DOCUMENTS

EP 0301734 2/1989
GB 2569732 6/2019
WO 2004097165 11/2004

OTHER PUBLICATIONS

International Patent Application No. PCT/US2017/039665 , "International Search Report and Written Opinion", dated Mar. 22, 2018, 20 pages.

(Continued)

*Primary Examiner* — Matthew R Buck
(74) *Attorney, Agent, or Firm* — Kilpatrick Townsend & Stockton LLP

(57) ABSTRACT

An indexing apparatus for use with a downhole tool may include a tubular body and a mandrel. The tubular body may have a first end and a second end. The tubular body may also have a plurality of body detents on the second end of the tubular body and a recess in a surface of the tubular body. The mandrel may include a plurality of mandrel detents on a surface of the mandrel. The mandrel detents may be sized and shaped to engage with the body detents on the second end of the tubular body. The indexing apparatus may also include a cam sized to be received in the recess of the surface of the tubular body and a spring coupled to the first end of the tubular body.

18 Claims, 8 Drawing Sheets

(56) References Cited

U.S. PATENT DOCUMENTS

| | | | | |
|---|---|---|---|---|
| 10,428,609 | B2 * | 10/2019 | Farrar | E21B 34/14 |
| 10,815,754 | B2 * | 10/2020 | Earle | E21B 34/102 |
| 2005/0034875 | A1 * | 2/2005 | McLoughlin | E21B 23/006 166/386 |
| 2007/0295514 | A1 | 12/2007 | Rohde et al. | |
| 2010/0193196 | A1 * | 8/2010 | McGarian | E21B 23/004 166/373 |
| 2010/0252276 | A1 * | 10/2010 | Clausen | E21B 23/006 166/381 |
| 2011/0147007 | A1 * | 6/2011 | O'Malley | E21B 23/004 166/373 |
| 2018/0163494 | A1 | 6/2018 | Le | |

OTHER PUBLICATIONS

GB. Application No. GB1912261.3 , Office Action, dated Sep. 6, 2021, 1 page.
CA. Application No. CA3,054,920 , Office Action, dated Jul. 16, 2021, 5 pages.
GB Application No. GB1912261.3 , "First Examination Report", dated Jul. 20, 2021, 5 pages.

* cited by examiner

CAM INDEXING APPARATUS

TECHNICAL FIELD

The present disclosure relates generally to tools positioned downhole in a well assembly, and more specifically, though not exclusively, to indexing systems for remotely actuated downhole tools that may be used in the production and operation of a well.

BACKGROUND

A well system (e.g., oil or gas wells for extracting fluids from a subterranean formation) may include tools positioned downhole. These tools may be actuated from the surface using an indexing apparatus. Tools can include, but are not limited to, flow control devices and circulating subs.

DETAILED DESCRIPTION

Figure 1:
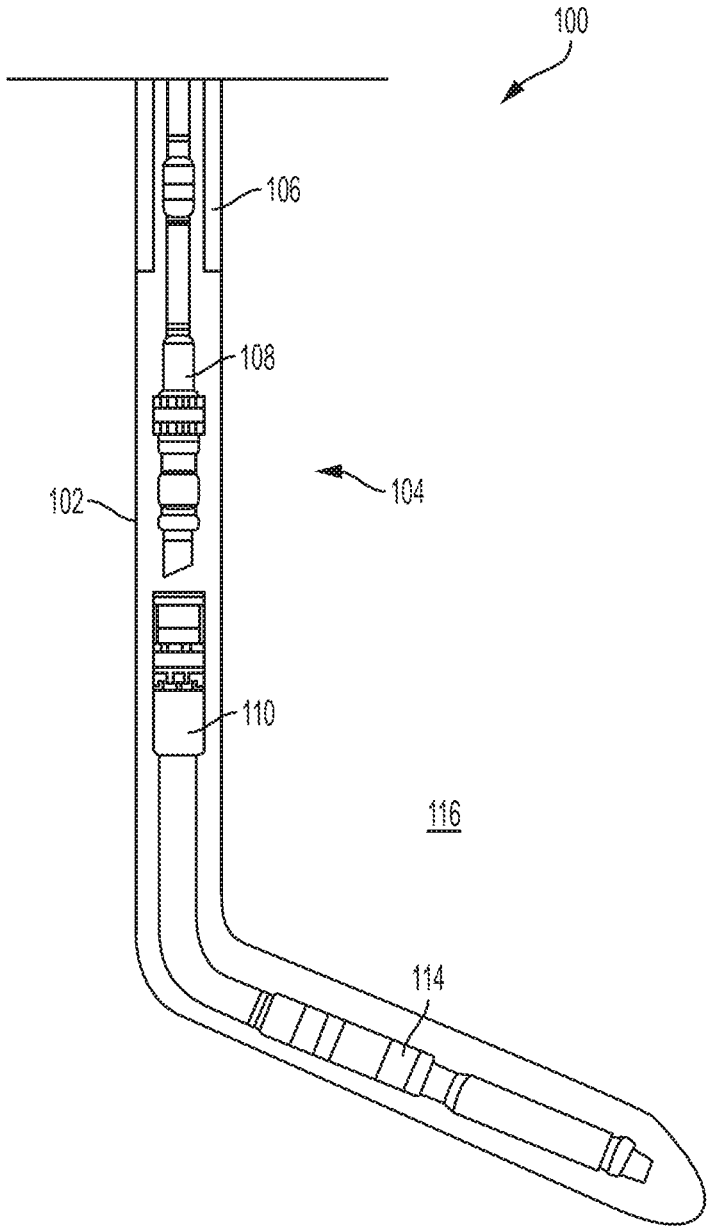
FIG. 1 is a schematic illustration of a well system including a downhole tool according to an aspect of the present disclosure.

Certain aspects and examples of the disclosure relate to controlling a valve of a tubing string of a downhole tool positioned within a wellbore. The valve may be a barrier valve that can selectively provide fluid flow between an interior region of the tubing string and an annulus. In a closed position, the valve can isolate the formation before an upper completion is installed in the wellbore of a well system. The valve may also permit pressure testing to confirm the position of the valve in the open position or the closed position. The valve may be actuated or opened from a surface of the wellbore by applying a pre-determined number of hydraulic cycles to an indexing apparatus of the tubing string that may control the position of the valve. Once the predetermined number of hydraulic cycles is applied to the indexing apparatus from the surface, the valve can be forced into an open position or a closed position. In the open position, fluid may flow through from the annulus into the interior of the tubing string. The indexing apparatus may also be resettable from the surface of the well system to permit the repeated opening and closing of the valve from the surface without removal of the tubing string from the wellbore.

The indexing apparatus may comprise a tubular body having an outer surface and an inner surface defining an inner region of the tubular body. The indexing apparatus may also comprise another tubular body, or mandrel, which may be partially positioned within the inner region of the tubular body. A first end of the tubular body may have multiple detents that are sized and shaped to engage with multiple detents on a surface of the mandrel. A cam may be positioned with a recess on the surface of the mandrel. The cam may be fixed in its position relative to the tubular body and the mandrel. In some aspects, the cam may be coupled to a housing of a downhole tool within which the indexing apparatus is positioned. The tubular body may also have a groove or recess that is sized to receive the cam. The tubular body and the mandrel may be able to move along a longitudinal axis with respect to the cam. The tubular body may also be able to rotate with respect to the mandrel and the cam.

The indexing apparatus may also include a spring coupled to a second end of the tubular body; the spring may apply a force to the second end of the tubular body. A force may also be applied to a second end of the mandrel. In some embodiments, a piston may apply the force to the second end of the mandrel. In some embodiments, another element or tractor device may apply the force to the second end of the mandrel. The piston may be a hydraulic piston that is activated by applying pressure from the surface of the wellbore. Thus, at one end of the indexing apparatus, a force is applied by a spring to the second end of the tubular body and at an opposite end of the indexing apparatus, a force may be applied to the second end of the mandrel. These dual forces can result in a bi-stable indexing apparatus that is consistently loaded by a force. This bi-stable feature can reduce backlash in the indexing apparatus during indexing.

The indexing apparatus may index (or rotate) both as the piston applies a force to the second end of the mandrel and as the force is released from the second end of the mandrel. The piston may be activated to apply the force by applying a pressure from the surface of the wellbore. In some aspects, the piston may be a hydraulic piston. Following a predetermined number of cycles of pressure application from the surface, the indexing apparatus may actuate causing a valve to open or to close in response to the actuation of the indexing apparatus. A single cycle of pressure application from the surface may include an application of force to the second end of the mandrel ("pressuring up") and the release of the force from the second end of the mandrel ("pressuring down").

The indexing apparatus may actuate when the cam is positioned within the groove or recess in the tubular body. The indexing apparatus may also be reset and re-actuated multiple times without removing the indexing apparatus from the wellbore. The cam may be removed from the groove in the tubular body, thereby resetting the indexing apparatus, by applying a force to the opposite end of the mandrel such that the tubular body is moved axially way from the cam in an amount sufficient to disengage the cam from the groove in the surface of the tubular body. The indexing apparatus may be actuated again from the reset position in response to applying a predetermined number of cycles of pressure from the surface.

FIG. 1 is a schematic illustration of a well system 100 that includes a bore that is a wellbore 102 extending through various earth strata. The wellbore 102 has a substantially vertical section 104 that may include a casing string 106 cemented at an upper portion of the substantially vertical section 104. The well system 100 may include an upper completion 108 positioned proximate to the casing string 106. The well system 100 may also include a lower completion string 110 positioned below the upper completion 108. A downhole tool 114 may be positioned within the well system 100 below the lower completion string 110. The downhole tool 114 may be a flow control device, a circulating sub, or other suitable downhole tools. The downhole tool 114 may include an open position in which fluid may flow from a surrounding formation 116 through an inner region of the downhole tool 114. The downhole tool 114 may also include a closed position that prevents fluid flow from the surrounding formation 116 through the inner region of the downhole tool 114. In the closed position, the downhole tool 114 may isolate the well system 100 from the surrounding formation 116. For example, the downhole tool 114 in the closed position may isolate the wellbore 102 from the surrounding formation 116 prior to installing the lower completion string 110.

Figure 2:
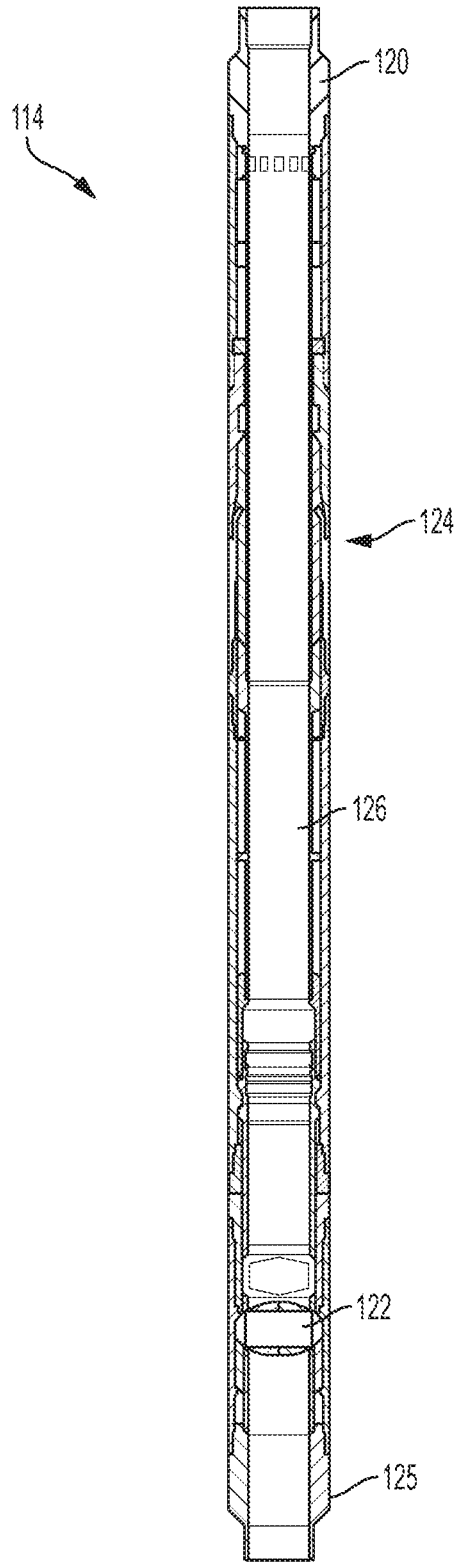
FIG. 2 is a cross-sectional side view of the downhole tool of FIG. 1 including an indexing apparatus according to an aspect of the present disclosure.

FIG. 2 depicts a cross-sectional side view of the downhole tool 114 according to an aspect of the present disclosure. The downhole tool 114 may be, for example but not limited to a flow control device or a circulating sub. The downhole tool 114 may include a tubing string 120, a valve 122 (e.g., a ball), and an indexing apparatus 124 for controlling the position of the valve 122. In some aspects, the downhole tool 114 may have additional features or elements. The downhole tool 114 may be in the open position when the valve 122 is in an open position to permit fluid flow from an outer surface 125 of the tubing string 120 through an inner region 126 of the tubing string 120. The downhole tool 114 may be in the closed position when the valve 122 is in a closed position to prevent fluid flow from the outer surface 125 through the inner region 126 of the tubing string 120. In the closed position, the downhole tool 114 may isolate the well system from a surrounding formation. For example, the downhole tool 114 in the closed position may isolate the wellbore from the formation prior to installing the lower completion string. The indexing apparatus 124 may be pressure tested from the surface to determine the position of the valve 122 (e.g., to determine if the valve is in the open or the closed position).

The indexing apparatus 124 of the downhole tool 114 can control the position of the valve 122 by opening or closing the valve 122 in response to an application of a predetermined number of hydraulic cycles from the surface of the wellbore. The indexing apparatus 124 may also be resettable, to permit the valve 122 to be moved between the closed position and the open position multiple times. In some aspects, actuation of the indexing apparatus 124 may move the downhole tool 114 from an open position to a closed position or vice versa.

Figure 3:
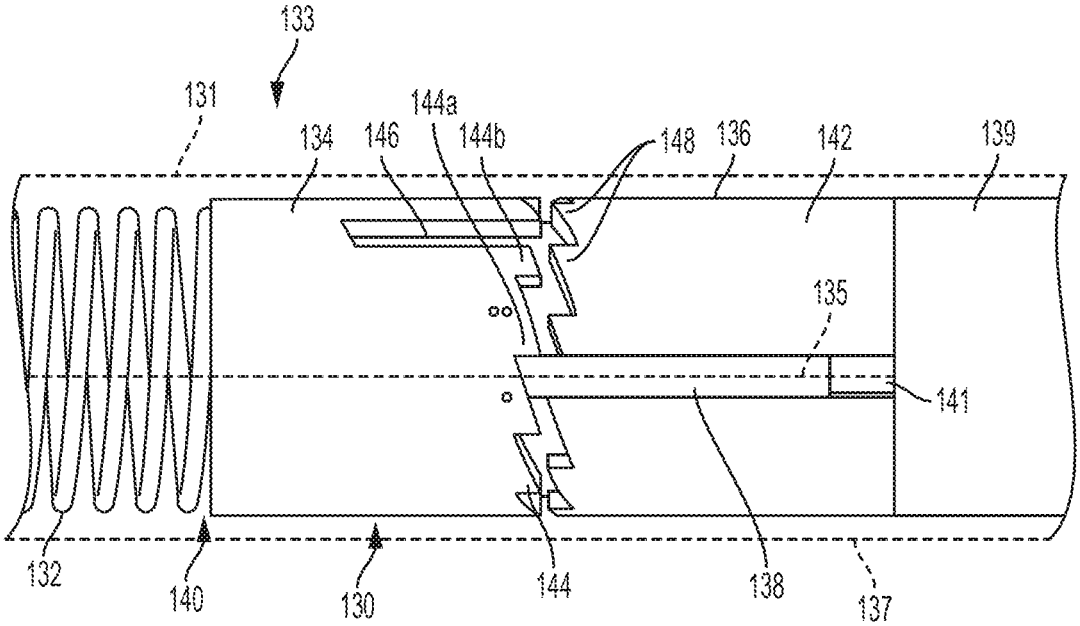
FIG. 3 is a schematic illustration of an indexing apparatus in an initial position according to an aspect of the present disclosure.

FIG. 3 depicts a side view of an indexing apparatus 130 positioned within a housing 131 of a tubing string 133 according to an aspect of the present disclosure. The tubing string 133 may be a downhole tool, for example but not limited to a flow control device or a circulating sub. For ease of viewing, the housing 131 and the tubing string 133 are not shown in FIGS. 4-18. The tubing string 133 may be a downhole tool, for example but not limited to a flow control device or a circulating sub. The indexing apparatus 130 is shown in FIG. 3 in a first position (or initial position). The first position of the indexing apparatus 130 can be the position the indexing apparatus 130 is in when it is run downhole in a wellbore for the initial installation. The indexing apparatus 130 may be coupled to the tubing string 133. The indexing apparatus 130 may include a spring 132, a first tubular body for example indexing body 134, another tubular body such as mandrel 136, and a cam 138. The indexing body 134 and the mandrel 136 may define a longitudinal axis 135 as shown in FIG. 3. The spring 132 may be coupled to the indexing body 134 on a first end 140 of the indexing body 134. The spring 132 may apply a force to the first end 140 of the indexing body 134. The indexing body 134 can have a circular cross-section, as shown in FIG. 3, though other cross-sections may be used, for example an oval cross-section. The mandrel 136 can also have a circular cross-section and a first end of the mandrel 136 can be received within an inner region of the indexing body 134. A force can be applied to a second end 137 of the mandrel 136, for example by a piston 139. The piston 139 may be a hydraulic piston that may be activated by an application of pressure from a surface of the wellbore. The hydraulic piston may be integral with the indexing apparatus 130 or a separate apparatus. The indexing apparatus 130 is thus constantly loaded, from either the spring 132 at the first end 140 of the indexing body 134 or the piston 139 on the second end 137 of the mandrel 136. This constant loading can make the indexing apparatus 130 more stable with less backlash during indexing and activation.

As shown in FIG. 3, the cam 138 may be positioned within a groove 141 on an outer surface 142 of the mandrel 136. The cam 138 may be fixed to the housing 131 of the tubing string 133. In some aspects, the cam 138 may be machined integral to the housing 131, or in some aspects, the cam 138 may be a separate item that is attached to the housing 131. For example, the cam 138 may be fixed to a housing of a downhole tool, for example but not limited to a flow control device, which includes the indexing apparatus 130. In some aspects, the cam 138 may be fixed to a separate sleeve or another housing positioned downhole. In other aspects, the cam 138 may be a machined part of a separate sleeve or another housing positioned downhole. The cam 138 is thereby fixed in its position and the mandrel 136 and the indexing body 134 may move relative to the cam 138. In some aspects, multiple cams may be used.

The indexing body 134 may also including a bearing (not shown) that permits the indexing body 134 to rotate freely relative to the mandrel 136 and the cam 138. The indexing body 134 may include a plurality of body detents 144 that may extend around a circumference of the indexing body 134. The body detents 144 may be helically cut. The maximum number of cycles the indexing body 134 may be indexed may be limited based on one or more of the circumference of the indexing body 134, the needs of the well (e.g., the diameter of the wellbore or the number of hydraulic cycles desired), or the size of the tubing string of the downhole tool (e.g., a flow control device or a circulating sub) to which the indexing apparatus 124 is coupled. The indexing body 134 may also include a recess 146 that is sized and shaped to receive the cam 138. For example, the recess 146 may be generally rectangular in shape, though in some aspects the recess 146 may have a different shape. The recess 146 may have a length that is greater than a length of the body detents 144 such that the cam 138.

The mandrel 136 can also include a plurality of mandrel detents 148 along a surface of the mandrel 136. The mandrel detents 148 may also be helically cut. The body detents 144 and the mandrel detents 148 are sized and shaped to engage with one another when aligned. The cam 138 can also have a size and shape that corresponds to the body detents 144 such that the body detents 144 can engage with the cam 138. The engagement of the cam 138 with the body detents 144 may prevent the indexing body 134 from rotating. The mandrel 136 may be locked rotationally by the cam 138 but may be moved laterally in a first direction along the longitudinal axis 135 in response to the piston 139 applying a force to the second end 137 of the mandrel 136. The indexing body 134 may also force the mandrel 136 to move laterally along the longitudinal axis 135 in a second direction.

The indexing apparatus 130 may have a predetermined number of cycles before the indexing apparatus 130 is activated. The indexing apparatus 130 may be activated when the cam 138 is engaged with the recess 146, causing a valve coupled to the indexing apparatus 130 to open or close. The number of cycles the indexing apparatus 130 may complete prior to activation may be determined by the number of body detents 144 and the initial position of the recess 146 in the indexing body 134 relative to the cam 138. For example, the number of body detents 144 between the cam 138 and the recess 146 when the indexing apparatus 130 is initially run downhole may determine the number of cycles of hydraulic pressure that are applied to the indexing apparatus 130 from the surface to activate the indexing apparatus 130.

FIG. 3 depicts the indexing apparatus 130 in the first position, which may be the position the indexing apparatus 130 is in when run downhole. In the first position, the indexing body 134 is spring loaded by the spring 132 on the first end 140 of the indexing body 134. The spring 132 can act to force the indexing body 134 against the cam 138. In some aspects, a force member other than a spring may be used to apply a force to the first end 140 of the indexing body 134. In the first position, shown in FIG. 3 with the cam 138 positioned against a body detent 144*a*, there remains two cycles before activation of the indexing apparatus 130 when the cam 138 is positioned within the recess 146 of the indexing body 134. The first cycle corresponds to moving the cam 138 from its initial position engaged with the body detent 144*a* to be engaged with a body detent 144*b* at the end of the first cycle. The second cycle corresponds to moving the cam 138 from engagement with the body detent 144*b* to engagement with the recess 146 of the indexing body, causing activation of the indexing apparatus 130. The first cycle is initiated from the first position by the piston 139 applying a force at the second end 137 of the mandrel 136. The force of the piston 139 at the second end 137 moves the mandrel 136 axially towards the indexing body 134 to a second position, shown in FIG. 4. The piston 139 may be moved to apply the force to the second end 137 of the mandrel 136 by applying pressure from the surface of the wellbore.

Figure 4:
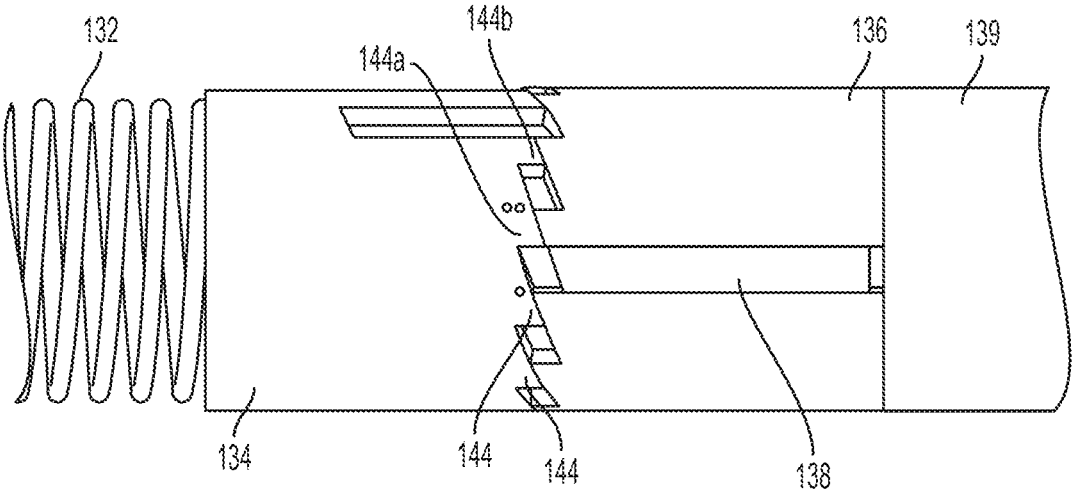
FIG. 4 is a schematic illustration of the indexing apparatus in a second position during a first indexing cycle according to an aspect of the present disclosure.

As shown in FIG. 4, in the second position, the cam 138 is no longer in contact with the indexing body 134. In the second position, the piston forces the mandrel 136 against the body detents 144 of the indexing body 134 and forces the spring 132 to compress. The body detent 144*a* of the indexing body 134 no longer engages with the cam 138. The disengagement between the body detent 144*a* of the indexing body 134 and the cam 138 permits the indexing body 134 to rotate.

Figure 5:
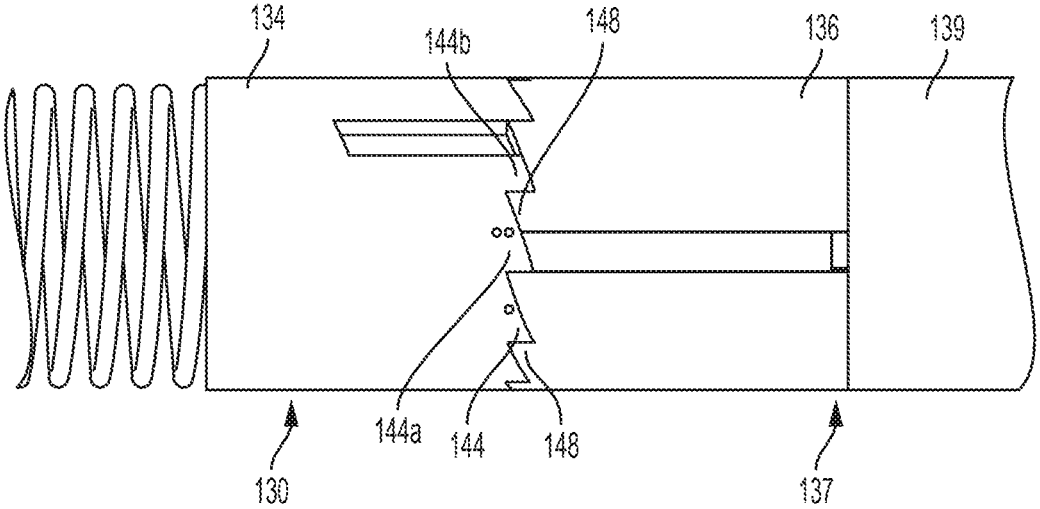
FIG. 5 is a schematic illustration of the indexing apparatus in a third position during the first indexing cycle according to an aspect of the present disclosure.

FIG. 5 depicts the indexing apparatus 130 at a third position, mid-index during the first cycle. In the third position, the indexing body 134 has rotated, the piston 139 is still applying a force to the second end 137 of the mandrel 136, and the body detents 144 and the mandrel detents 148 are engaged. The engagement of the body detents 144 and the mandrel detents 148 can prevent the indexing body 134 from rotating. Subsequently, the piston pressure at the second end 137 of the mandrel 136 is released.

Figure 6:
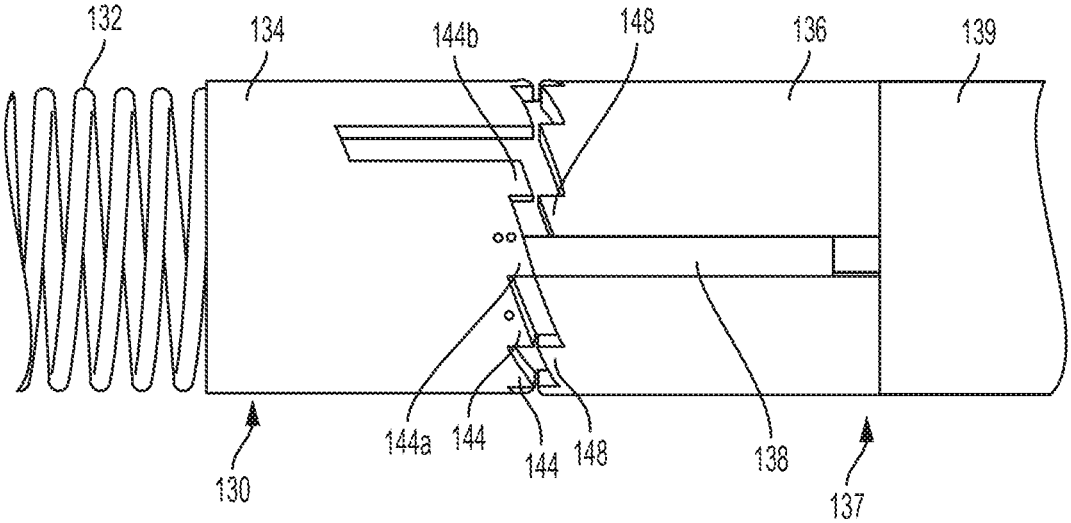
FIG. 6 is a schematic illustration of the indexing apparatus in a fourth position during the first indexing cycle according to an aspect of the present disclosure.

FIG. 6 depicts the indexing apparatus 130 at a fourth position, as the piston pressure applied by the piston 139 at the second end 137 of the mandrel 136 is mid-release. With the decreasing piston pressure at the second end 137 of the mandrel 136, the mandrel 136 retracts away from the indexing body 134 disengaging the body detents 144 and the mandrel detents 148. The spring 132 forces the indexing body 134 towards the mandrel 136. The cam 138, which is stationary, is in contact with a surface of the indexing body 134 but is not engaged with a body detent 144. The body detents 144 are not engaged with the mandrel detents 148, and the cam 138 is not engaged with a body detent 144 permitting the indexing body 134 to rotate.

Figure 7:
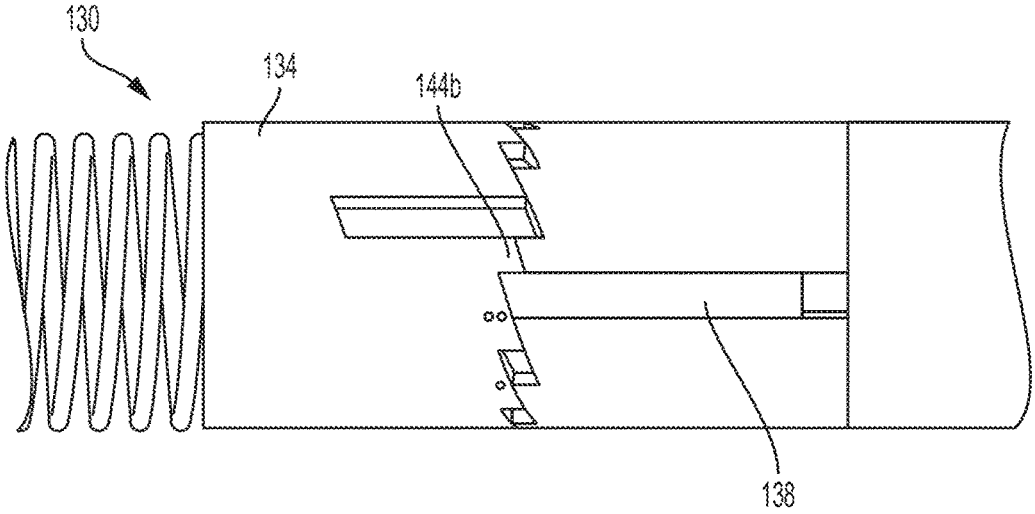
FIG. 7 is a schematic illustration of the indexing apparatus in a fifth position during the first indexing cycle according to an aspect of the present disclosure.
Figure 8:
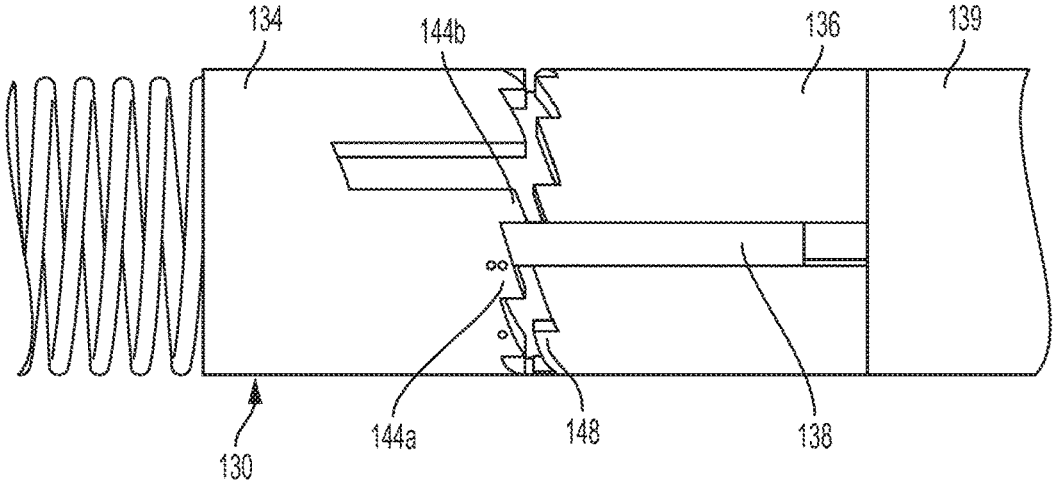
FIG. 8 is a schematic illustration of the indexing apparatus in a sixth, final position during the first indexing cycle and first, starting position during a second indexing cycle, according to an aspect of the present disclosure.

FIG. 7 depicts the indexing apparatus 130 at a fifth position, following the rotation of the indexing body 134. As shown in FIG. 7, the indexing body 134 is free to rotate until the cam 138 becomes engaged with a body detent 144*b* of the indexing body 134 preventing further rotation of the indexing body 134. FIG. 8 depicts the indexing apparatus at a sixth position and final position for the first indexing cycle. From the fifth position (shown in FIG. 7), the force applied by the piston 139 to the second end 137 of the mandrel 136 is fully released and the mandrel 136 retracts further, separating the mandrel detents 148 from the body detents 144. From the first position (shown in FIG. 3) to the sixth position (shown in FIG. 8) is one indexing cycle of the indexing apparatus 130. The sixth position of the indexing apparatus 130 is similar to the first position of the indexing apparatus 130, except with the cam 138 engaged with the body detent 144*b* (shown in FIG. 8) as opposed to the body detent 144*a* (shown in FIG. 3). The single indexing cycle described above corresponds to the cam 138 moving from the body detent 144*a* to the second body detent 144*b* as seen by comparing the position of the cam 138 in FIG. 3 to the position of the cam 138 in FIG. 8.

One indexing cycle of the indexing apparatus 130 corresponds to a single application of pressure from the surface to activate the piston 139 to apply a force to the mandrel 136 and the full release of that pressure from the surface. The release of pressure of the surface corresponds to the piston 139 reducing the force (or amount of pressure) applied to the second end 137 of the mandrel 136. The application of pressure from the surface corresponding to the application of force by the piston 139 on the mandrel 136 during one indexing cycle corresponds to FIGS. 4-5, which can be referred to as "pressuring-up" the indexing apparatus 130. The subsequent release of pressure from the surface corresponding to the reduction in force applied by the piston 139 on the second end 137 of the mandrel 136 corresponds to FIGS. 6-8, which can be referred to as "pressuring-down" the indexing apparatus 130. As described above with reference to the figures, the indexing body 134 rotates during both the "pressuring-up" and the "pressuring-down" phases of the indexing cycle.

Figure 9:
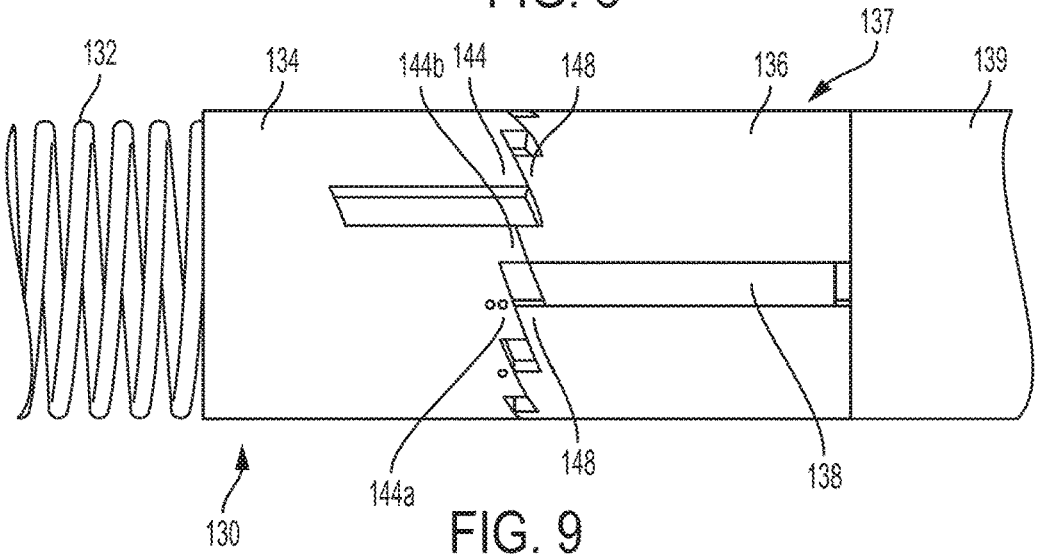
FIG. 9 is a schematic illustration of the indexing apparatus in a second position during the second indexing cycle according to an aspect of the present disclosure.

The indexing apparatus 130 commences a second cycle from the sixth position shown in FIG. 8. To commence the second cycle the indexing apparatus 130 again pressures-up by forcing the piston 139 against the second end 137 of the mandrel 136. As shown in FIG. 9, the pressure of the piston 139 on the second end 137 of the mandrel 136 forces the mandrel 136 towards the indexing body 134 and forces the indexing body 134 away from the cam 138, compressing the spring 132. The indexing body 134 moves away from the cam 138 an amount sufficient to disengage the cam 138 from the body detent 144*b*. The body detents 144 of the indexing body 134 are also disengaged from the mandrel detents 148 of the mandrel 136, freeing the indexing body 134 to rotate.

Figure 10:
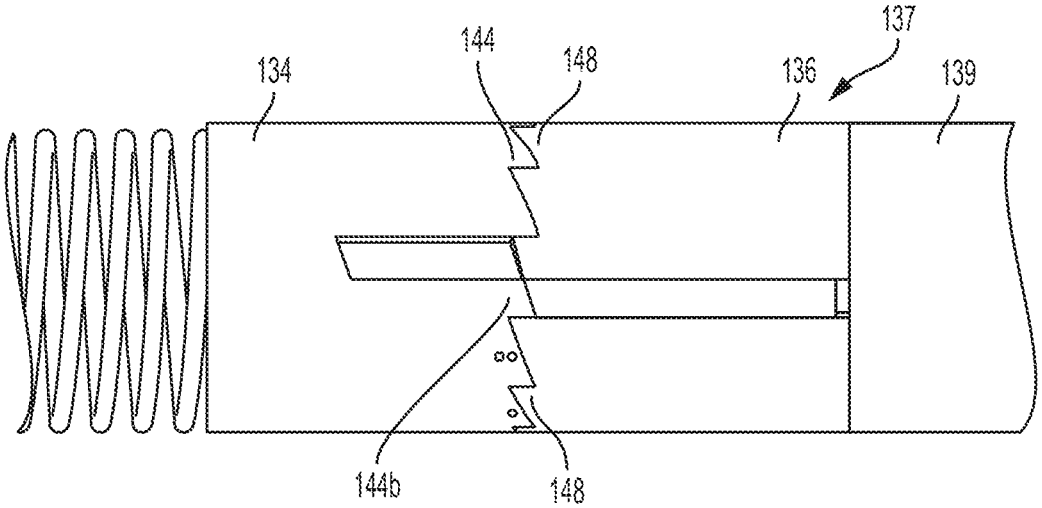
FIG. 10 is a schematic illustration of the indexing apparatus in a third position during the second indexing cycle according to an aspect of the present disclosure.

As shown in FIG. 10, the indexing body 134 rotates to a mid-index position in which the body detents 144 of the indexing body 134 are engaged with the mandrel detents 148 of the mandrel 136. The engagement of the body detents 144 and the mandrel detents 148 prevent further rotation of the indexing body 134. At the position shown in FIG. 10, the piston 139 continues to apply pressure the second end 137 of the mandrel 136.

Figure 11:
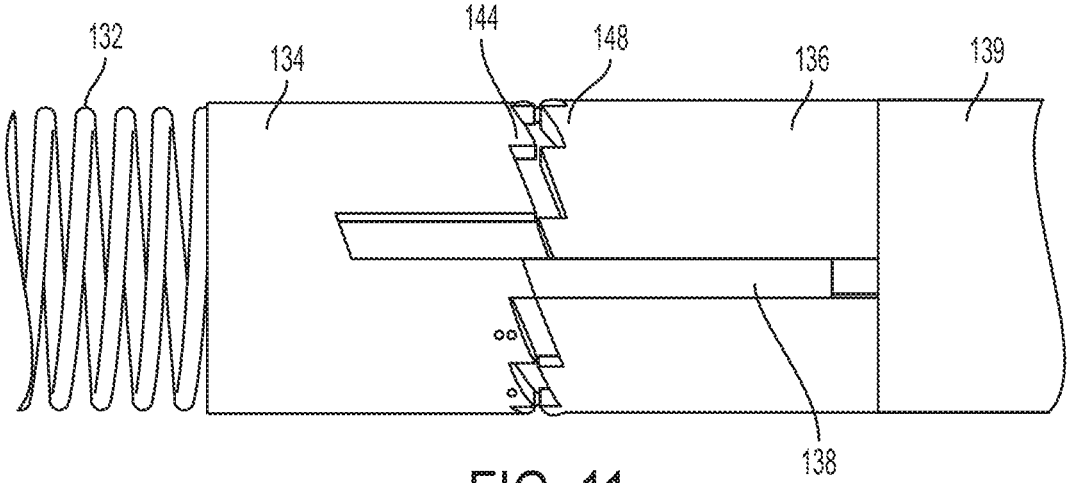
FIG. 11 is a schematic illustration of the indexing apparatus in a fourth position during the second indexing cycle according to an aspect of the present disclosure.
Figure 12:
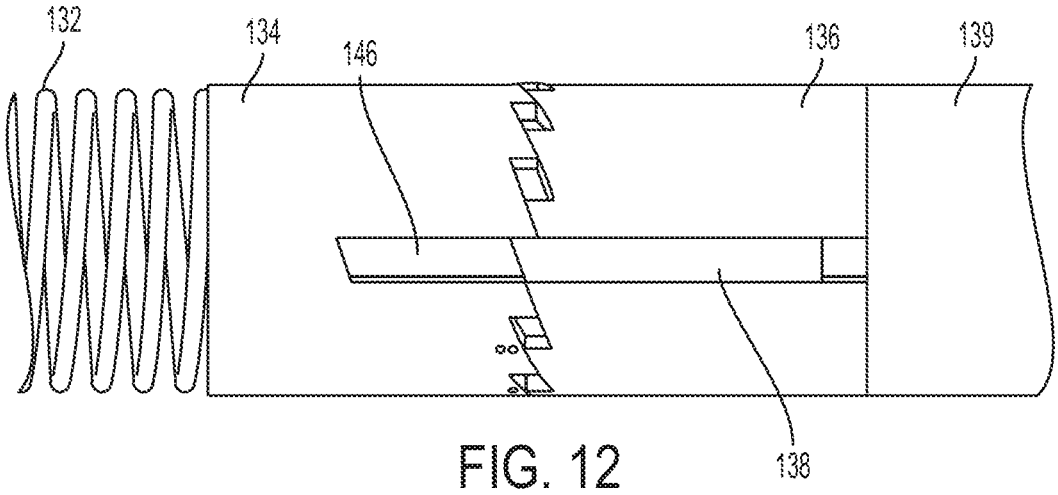
FIG. 12 is a schematic illustration of the indexing apparatus in a fifth position during the second indexing cycle according to an aspect of the present disclosure.

FIG. 11 depicts the indexing apparatus 130 as the amount of pressure the piston 139 is applying to the mandrel 136 is decreased, "pressuring-down" during the second cycle. As the amount of pressure applied by the piston 139 is decreased, the mandrel 136 is retracts toward the piston 139. As the mandrel 136 moves axially towards the piston 139, the body detents 144 and the mandrel detents 148 disengage from one another. The cam 138 is not engaged with any of the body detents 144 in the position shown in FIG. 11, and the indexing body 134 is thus free to rotate. From the position shown in FIG. 11, the indexing body 134 rotates. As the indexing body 134 rotates, the cam 138 becomes aligned with the recess 146, shown in FIG. 12.

Figure 13:
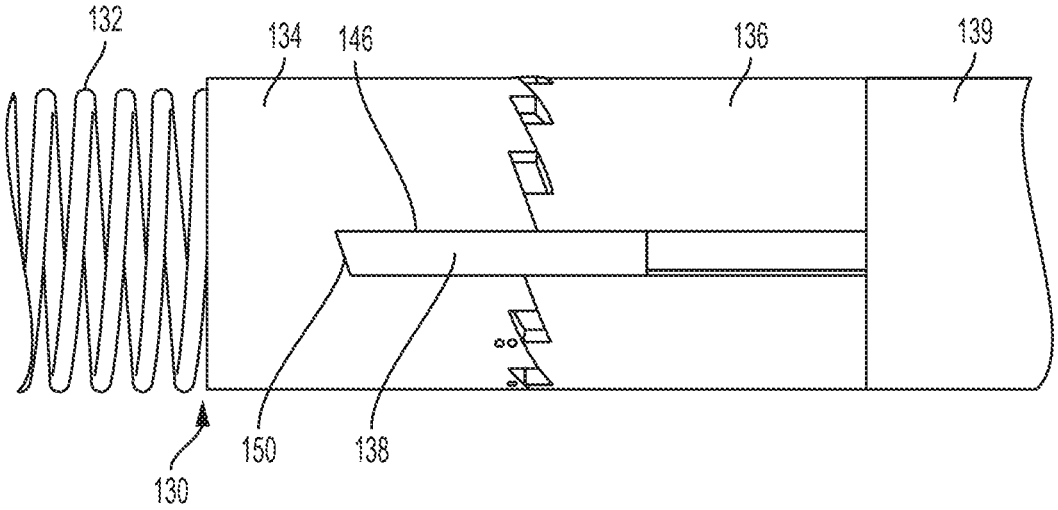
FIG. 13 is a schematic illustration of the indexing apparatus in a sixth, final position during the second indexing cycle in which the indexing apparatus is activated according to an aspect of the present disclosure.

FIG. 13 depicts the position of the indexing apparatus 130 as the pressure applied by the piston 139 is fully released. As the piston pressure is fully released, the spring 132 forces the indexing body 134 towards the mandrel 136. The indexing body 134 moves axially towards to mandrel 136 pushing the mandrel 136 towards the piston 139. As the indexing body 134 moves axially towards the mandrel 136 the cam 138 becomes positioned within the recess 146 of the indexing body 134, as shown in FIG. 13, completing the second cycle of indexing. The engagement of the cam 138 and the recess 146 can prevent the indexing body 134 from rotating further. In some aspects, the spring 132 forces the indexing body 134 toward the mandrel 136 until an end 150 of the cam 138 is flush against a surface of the indexing body 134 that defines the end of the recess 146, preventing the indexing body 134 from moving any further.

The movement of the indexing body 134 along the length of the cam 138 as the cam 138 is received by the recess 146 can force the mandrel 136 to move towards the piston 139. The movement of the mandrel 136 can directly or indirectly axially move a sleeve, the movement of the sleeve may cause a valve of a fluid control device or other device to move to an open position. In some aspects, the movement of the mandrel 136 can cause a latch mechanism to become de-supported, causing the valve to open. In some aspects, the movement of the mandrel 136 can cause a sliding sleeve of a tubular, such as a circulating sub, to release a valve to move to an open position. With the cam 138 received within the recess 146, the indexing apparatus 130 is said to be in the activated position, in which the valve is moved to the open position. In some aspects, the actuation of the indexing apparatus 130 may cause a valve to be moved to a closed position.

Though FIGS. 3-13 depict the indexing apparatus 130 requiring two pressure cycles to activate of the indexing apparatus 130, more or fewer cycles may be used in other aspects of the present disclosure. For example, the indexing apparatus 130 could be run in hole with the recess 146 of the indexing body 134 positioned more than two body detents 144 away from the cam 138, thus it would take more than two cycles indexing to position the cam 138 within the recess 146. In some aspects, the cam 138 may be two, four, six, eight, or any other suitable number of body detents 144 away from the recess 146 in the indexing body 134 when the indexing apparatus 130 is run downhole. In some aspects, an indexing body of an indexing apparatus may comprise more or fewer detents than shown in the aspect of FIGS. 3-13. For example, in some aspects, an indexing body may have five, ten, fifteen, twenty or any other suitable number of detents positioned about its circumference. In some aspects, the circumference of the indexing body can determine at least in part the number of detents.

Figure 14:
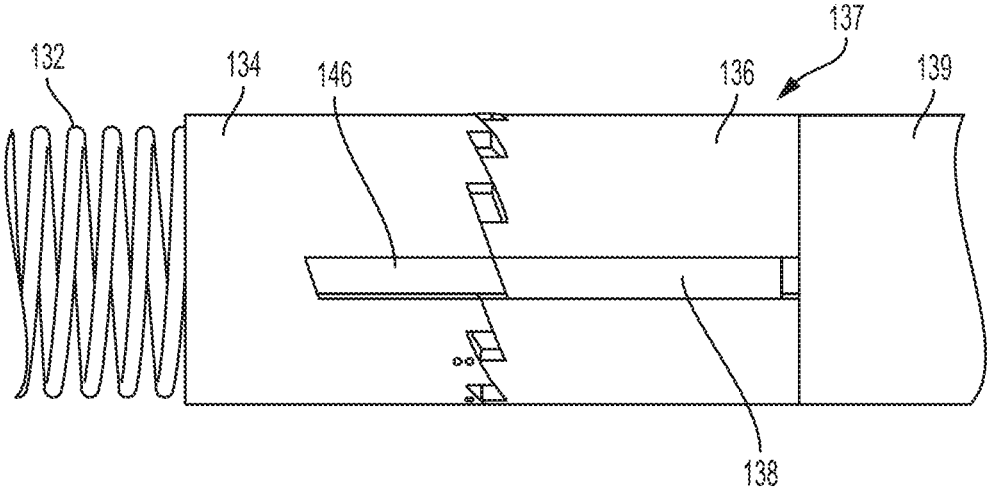
FIG. 14 is a schematic illustration of the indexing apparatus in a first position during resetting of the indexing apparatus according to an aspect of the present disclosure.

From the activated position, shown in FIG. 13, the indexing apparatus 130 can be reset to permit additional cycles to re-activate the indexing apparatus 130 without having to remove the indexing apparatus 130 from the wellbore. To reset the indexing apparatus 130 from the activated position (shown in FIG. 13), the indexing apparatus 130 may be pressured-up by applying pressure from the surface to force the piston 139 to apply pressure to the second end 137 of the mandrel 136. The piston 139 can force the mandrel 136 to move axially towards the indexing body 134. The mandrel 136 can force the indexing body 134 to move axially away from the cam 138, compressing the spring 132. The piston 139 can continue to force the mandrel 136 towards the indexing body 134 and thereby force the indexing body 134 to continue to move axially towards the spring 132, until the indexing body 134 has moved axially away from the cam 138 enough to disengage the cam 138 from the recess 146, as shown in FIG. 14. The movement of the mandrel 136 and the indexing body 134 towards the spring 132 in the amount sufficient to release the cam 138 from the recess 146 in the indexing body 134 can directly or indirectly axially move a sleeve or other component to causes the valve of a fluid control device or other device to return to the open position. For example, in some aspects, the mandrel 136 may be coupled to a sliding sleeve of a tubular body (e.g., a fluid control device or a circular sub). The sliding sleeve may move between a first position and a second position in response to the movement of the mandrel 136. The position of the sliding sleeve may control the position of a valve of the tubular body. In some aspects, the movement of the mandrel 136 to release the cam 138 from the recess 146 may force a sliding sleeve to move to a position that forces a valve to move from an open position to a closed position. In some aspects, the mandrel 136 may be coupled to a valve by other means sufficient to control the position of the valve in response to the movement of the mandrel 136.

Figure 15:
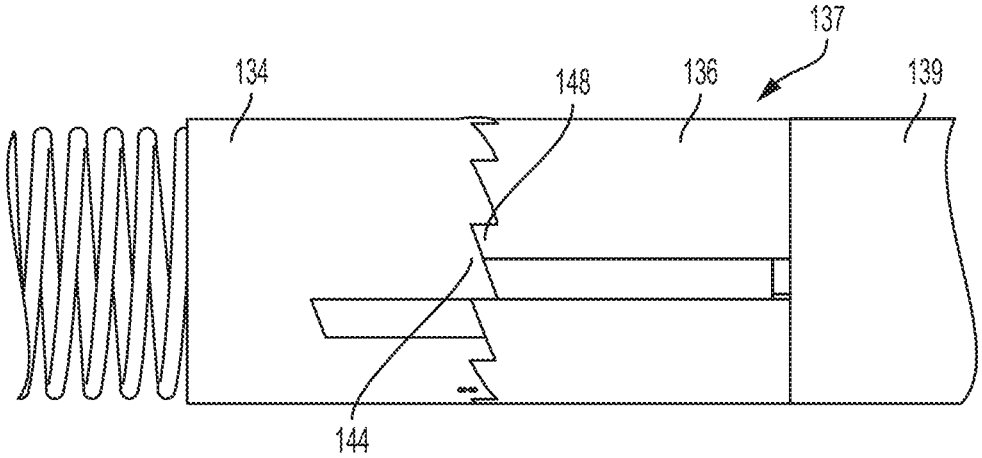
FIG. 15 is a schematic illustration of the indexing apparatus in a second position during resetting of the indexing apparatus according to an aspect of the present disclosure.

In the position shown in FIG. 14, the cam 138 is disengaged from the recess 146 and the body detents 144 are disengaged from the mandrel detents 148 allowing the indexing body 134 to rotate. FIG. 15 depicts the indexing body in the mid-index position following the rotating of the indexing body 134. As shown in FIG. 15 the indexing body 134 may rotate until the body detents 144 become engaged with the mandrel detents 148, preventing the indexing body 134 from rotating any further.

From the mid-index position shown in FIG. 15, the pressure applied by the piston 139 on the second end 137 of the mandrel 136 is reduced, as the pressure is reduced, the mandrel 136 retracts and moves axially away from the indexing body 134.

Figure 16:
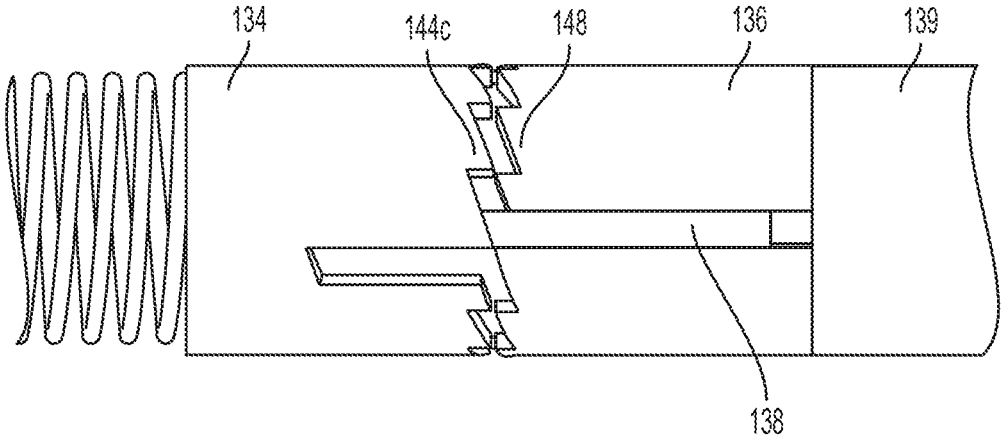
FIG. 16 is a schematic illustration of the indexing apparatus in a third position during resetting of the indexing apparatus according to an aspect of the present disclosure.
Figure 17:
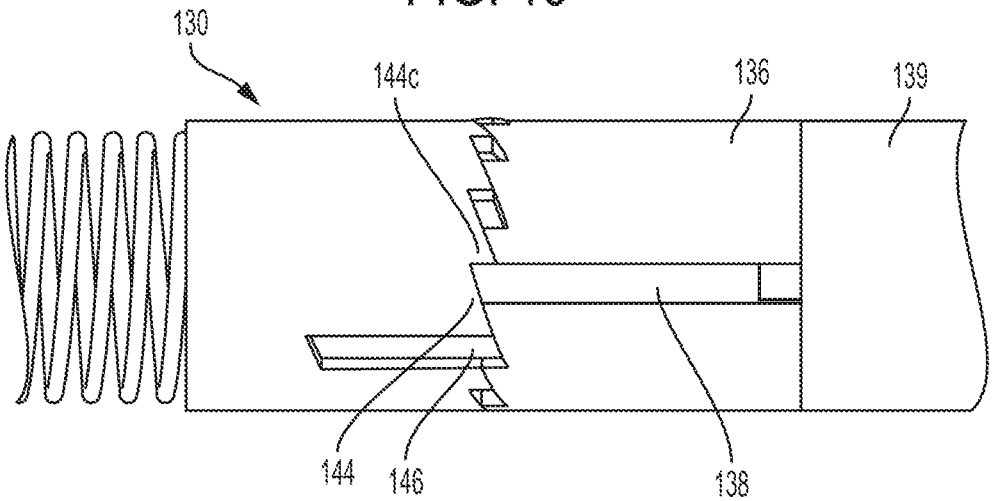
FIG. 17 is a schematic illustration of the indexing apparatus in a fourth position during resetting of the indexing apparatus according to an aspect of the present disclosure.
Figure 18:
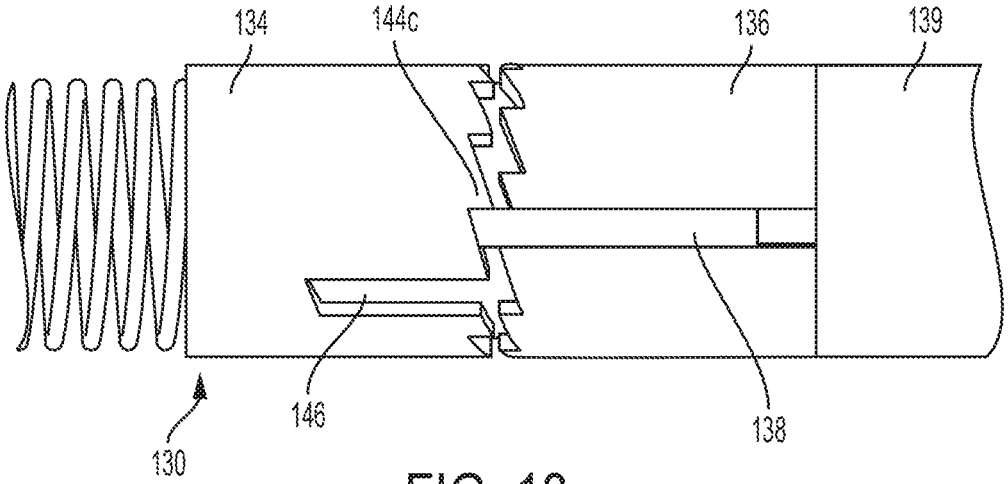
FIG. 18 is a schematic illustration of the indexing apparatus in a fifth and final position in which the indexing apparatus has been reset according to an aspect of the present disclosure.

As shown in FIG. 16, the movement of the mandrel 136 away from the indexing body 134 disengages the body detents HI and the mandrel detents 148. With the body detents 144 disengaged from the mandrel detents 148 the indexing body 134 is free to rotate. The indexing body 134 can rotate until the cam 138 becomes engaged with the body detent 144*c*, preventing the indexing body 134 from rotating any further, as shown in FIG. 17. The pressure applied by the piston 139 against the second end 137 of the mandrel 136 is then fully released permitting the mandrel 136 to move further towards the piston 139 and away from the indexing body 134. As the mandrel 136 moves away from the indexing body 134, the engagement between the cam 138 and the body detent 144*c* continues to prevent the indexing body 134 from rotating any further, as shown in FIG. 18. The indexing apparatus 130 as shown in FIG. 18 is in a reset position and can now engage in the pre-determined number of cycles to activate the indexing apparatus 130 again.

The indexing apparatus 130 may be a component that may be installed with a downhole tool, for example but not limited to a fluid control device, a circulating sub, or other suitable downhole tools. For example, in some aspects of the disclosure the indexing apparatus 130 may be part of a circulating sub, in such an aspect a sliding sleeve may be coupled to the indexing apparatus 130 for controlling the position of the valve. The indexing apparatus 130 may have a length that is between about one foot and about four feet (about 0.3 meter to about 1.2 meters), in some aspects the indexing apparatus 130 may be approximately two feet long (about 0.6 meter). The relatively small size of the indexing apparatus 130 can improve the ability to test the indexing apparatus 130 prior to installation. As described above, the indexing apparatus 130 is capable of being reset while positioned downhole, without having to remove the indexing apparatus 130 or the downhole device it is installed within from the wellbore.

Example 1: An indexing apparatus may comprise a tubular body, a mandrel, a cam, and a spring. The tubular body may comprise a first end and a second end. The tubular body may further comprise a plurality of body detents on the second end of the tubular body and a recess in a surface of the tubular body. The mandrel may comprise a plurality of mandrel detents on a surface of the mandrel, each mandrel detent of the plurality of mandrel detents may be sized and shaped to engage with a body detent of the plurality of body detents on the second end of the tubular body. The cam may be sized to be received in the recess of the surface of the tubular body. The spring may be coupled to the first end of the tubular body.

Example 2: The indexing apparatus of Example 1 may further comprise a piston positioned at an end of the mandrel for applying a force to the end of the mandrel.

Example 3: The indexing apparatus of any of Examples 1-2 may further comprise the cam being fixed to a housing of a tubing string in which the indexing apparatus is positioned.

Example 4: The indexing apparatus of any of Examples 1-3 may further comprise the body detents and the mandrel detents being helically cut.

Example 5: The indexing apparatus of any of Examples 1-4 may comprise the indexing apparatus having a length that is between approximately 1 foot and approximately 4 feet.

Example 6: The indexing apparatus of any of Examples 1-5 may comprise the mandrel being movable axially towards the tubular body in response to a force being applied on an end of the mandrel.

Example 7: The indexing apparatus of Example 6, further comprising the tubular body being movable axially away from an end of the cam to disengage the cam from the recess in the surface of the tubular body in response to the force being applied the end of the mandrel.

Example 8: The indexing apparatus of any of Examples 1-7 further comprising the cam being positioned within a groove in the surface of the mandrel.

Example 9: A tubing assembly may comprise a tubing string and an indexing apparatus. The tubing string may comprise a housing defining an inner region of the tubing string and a valve positioned in the inner region of the tubing string. The indexing apparatus may be positioned within the inner region of the tubing string and coupled to the valve. The indexing apparatus may comprise a tubular body having a first end and a second end, the tubular body also having a plurality of body detents on the second end of the tubular body and a recess in a surface of the tubular body. The indexing apparatus may also comprise a mandrel comprising a plurality of mandrel detents on a surface of the mandrel, the mandrel detents may be sized and shaped to engage with the body detents on the tubular body. The indexing apparatus may also comprise a cam sized to be received in the recess of the surface of the tubular body, as well as force member coupled to the first end of the tubular body.

Example 10: The tubing assembly of Example 9 may further comprise a piston at an end of the mandrel for applying a force to the end of the mandrel.

Example 11: The tubing assembly of any of Examples 9-10 may further comprise the cam being a separate element from the housing of the tubing string.

Example 12: The tubing assembly of Example 11 may also feature the cam being coupled to the housing of the tubing string.

Example 13: The tubing assembly of any of Examples 9-12 may further comprise the force member being a spring.

Example 14: The tubing assembly of any of Examples 9-13 may further comprise the cam being positioned within a groove in a surface of the mandrel.

Example 15: The tubing assembly of Example 10 may further comprise the piston being a hydraulic piston that activates in response to a pressure being applied from a surface of a wellbore within which the tubing assembly is positioned.

Example 16: The tubing assembly of any of Examples 9-15 may further comprise the tubing assembly having a length that is between approximately 1 foot and approximately 4 feet.

Example 17: The tubing assembly of any of Examples 9-16 may further comprise the tubing string being a flow control device.

Example 18: An indexing assembly may comprise a first tubular body, a second tubular body, a spring, and a cam. The first tubular body may have a plurality of detents on a first end, a surface of the first tubular body defining an inner region of the first tubular body. The second tubular body may have a plurality of detents on a surface of the second tubular body, the plurality of detents may be sized to receive the plurality of detents on the first end of the first tubular body. A first end of the second tubular body may be sized to be received in the inner region of the first tubular body. The spring may be configured to apply a force to a second end of the first tubular body. The force applied by the spring may oppose a force applied to a second end of the second tubular body. The cam may be sized to be received within a recess in the surface of the first tubular body. The first tubular body may be rotatable with respect to the second tubular body and may move axially along a longitudinal axis. The second tubular body may be movable axially along the longitudinal axis.

Example 19: The indexing assembly of Example 18 may further comprise the cam being fixed in place relative to the first tubular body and the second tubular body.

Example 20: The indexing assembly of any of Examples 18-19 may further comprise the second tubular body moving the first tubular body to axially away from an end of the cam to disengage the cam from the recess in the surface of the first tubular body.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

That which is claimed is:

1. An indexing apparatus comprising:

a tubular body comprising:

a first end and a second end;

a plurality of body detents on the second end of the tubular body, each body detent of the plurality of body detents having a first length and being helically cut; and a recess in a surface of the tubular body, the recess having a second length that is greater than the first length of each body detent;

a mandrel comprising a plurality of mandrel detents on a surface of the mandrel, each mandrel detent of the plurality of mandrel detents being sized and shaped to engage with a body detent of the plurality of body detents on the second end of the tubular body, and each mandrel detent of the plurality of mandrel detents being helically cut;

a cam sized to be received in the recess of the surface of the tubular body; and a spring coupled to the first end of the tubular body.

2. The indexing apparatus of claim 1, further comprising a piston positioned at an end of the mandrel for applying a force to the end of the mandrel.

3. The indexing apparatus of claim 1, wherein the cam is fixed to a housing of a tubing string in which the indexing apparatus is positioned.

4. The indexing apparatus of claim 1, wherein the indexing apparatus has a length that is between approximately 1 foot and approximately 4 feet.

5. The indexing apparatus of claim 1, wherein the mandrel is movable axially towards the tubular body in response to a force being applied on an end of the mandrel.

6. The indexing apparatus of claim 5, wherein the tubular body is movable axially away from an end of the cam to disengage the cam from the recess in the surface of the tubular body in response to the force being applied on the end of the mandrel.

7. The indexing apparatus of claim 1, wherein the cam is positioned within a groove in the surface of the mandrel.

8. A tubing assembly, comprising:

a tubing string comprising a housing defining an inner region of the tubing string;

a valve positioned in the inner region of the tubing string; and an indexing apparatus positioned within the inner region of the tubing string and coupled to the valve, the indexing apparatus further comprising:

a tubular body having a first end and a second end, the tubular body having a plurality of body detents on the second end of the tubular body, each body detent of the plurality of body detents having a first length, the tubular body also having a recess in a surface of the tubular body, wherein the recess has a second length that is greater than the first length of each body detent of the plurality of body detents, a mandrel comprising a plurality of mandrel detents on a surface of the mandrel, the mandrel detents being sized and shaped to engage with the body detents on the tubular body, a cam sized to be received in the recess of the surface of the tubular body, and a spring coupled to the first end of the tubular body.

9. The tubing assembly of claim 8, further comprising a piston at an end of the mandrel for applying a force to the end of the mandrel.

10. The tubing assembly of claim 8, wherein the cam is a separate element from the housing of the tubing string.

11. The tubing assembly of claim 10, wherein the cam is coupled to the housing of the tubing string.

12. The tubing assembly of claim 8, wherein the cam is positioned within a groove in a surface of the mandrel.

13. The tubing assembly of claim 9, wherein the piston is a hydraulic piston that activates in response to a pressure being applied from a surface of a wellbore within which the tubing assembly is positioned.

14. The tubing assembly of claim 8, wherein the tubing assembly has a length that is between approximately 1 foot and approximately 4 feet.

15. The tubing assembly of claim 8, wherein the tubing string is a flow control device.

16. An indexing assembly comprising:

a first tubular body having a plurality of detents on a first end wherein each detent of the plurality of detents is helically cut and has a first length, a surface of the first tubular body defining an inner region of the first tubular body; and a second tubular body having a plurality of detents on a surface of the second tubular body wherein each detent is helically cut, the plurality of detents being sized to receive the plurality of detents on the first end of the first tubular body, a first end of the second tubular body being sized to be received in the inner region of the first tubular body, a spring configured to apply a force to a second end of the first tubular body, wherein the force applied by the spring opposes a force applied to a second end of the second tubular body, a cam sized to be received within a recess in the surface of the first tubular body, the recess having a second length that is greater than the first length, wherein the first tubular body is rotatable with respect to the second tubular body and may move axially along a longitudinal axis, and wherein the second tubular body is movable axially along the longitudinal axis.

17. The indexing assembly of claim 16, wherein the cam is fixed in place relative to the first tubular body and the second tubular body.

18. The indexing assembly of claim 16, wherein the second tubular body moves the first tubular body to axially away from an end of the cam to disengage the cam from the recess in the surface of the first tubular body.

* * * * *